US006526608B1

(12) United States Patent
Hsia

(10) Patent No.: US 6,526,608 B1
(45) Date of Patent: Mar. 4, 2003

(54) BASSINET WITH MOUNTING ARRANGEMENT FOR PLAY PEN AND COT

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 0 days.

(21) Appl. No.: 09/950,231

(22) Filed: Sep. 11, 2001

(51) Int. Cl.[7] ..... A47C 7/00
(52) U.S. Cl. ..... 5/99.1; 5/93.1; 5/98.1
(58) Field of Search ..... 5/93.1, 93.2, 94, 5/95, 98.1, 98.3, 99.1; 297/19

(56) References Cited

U.S. PATENT DOCUMENTS 2,622,250 A * 12/1952 Coles ..... 5/99.1
3,127,620 A * 4/1964 Peterson ..... 5/99.1
3,487,479 A * 1/1970 Grooms ..... 5/93.1
3,699,594 A * 10/1972 Matthey-Doret ..... 5/93.1
3,735,430 A * 5/1973 Platz ..... 5/93.1
4,638,967 A * 1/1987 MacDuffee ..... 5/99.1
4,698,862 A * 10/1987 Mairs ..... 5/99.1
4,819,285 A * 4/1989 Fetters ..... 5/99.1
4,967,432 A * 11/1990 Kujawski et al. ..... 5/98.1
4,999,863 A * 3/1991 Kane ..... 5/98.1
5,778,465 A * 7/1998 Myers ..... 5/99.1
5,845,349 A * 12/1998 Tharalson et al. ..... 5/99.1
6,058,528 A * 5/2000 Yang ..... 5/93.1
6,131,218 A * 10/2000 Wang ..... 5/93.1
6,148,456 A * 11/2000 Tharalson et al. ..... 5/99.1
6,192,535 B1 * 2/2001 Warner, Jr. et al. ..... 5/93.1

* cited by examiner

*Primary Examiner*—Lynne H. Browne
*Assistant Examiner*—James M Hewitt
(74) *Attorney, Agent, or Firm*—Raymond Y. Chan; David & Raymond Patent Group

(57) ABSTRACT

A bassinet includes a fabric boundary having a receiving cavity to provide at least an opening edge, a supporting board fittedly disposed in the receiving cavity, a supporting frame including an edge supporting rim mounted on the opening edge of the fabric boundary, two folding arms pivotally connected to the edge supporting rim and arranged to move between a fully opened position and a closed position, and a locking mechanism provided on the supporting board for locking up the two folding arms in the fully opened position, and a mounting arrangement for detachably mounting on the play pen and cot respectively. In which, in the fully opened position, the two folding arms are move to perpendicularly bias against the supporting board, and in the closed position, the two folding arms are pivotally rotated towards to the top opening so as to reduce a depth of the receiving cavity.

26 Claims, 6 Drawing Sheets

BASSINET WITH MOUNTING ARRANGEMENT FOR PLAY PEN AND COT

BACKGROUND OF THE PRESENT INVENTION

1. Field of Invention

The present invention relates to baby accessories, and more particularly to a bassinet with mounting arrangement for play pen or cot, which can be folded into a compact unit for storage and carriage and unfolded to rigidly support on a play pen or cot.

2. Description of Related Arts

Stroller becomes a necessity to every family having a young child or baby. It is considered as a convenience outdoor tool to carry the baby or young child, such as during foot traveling or shopping. However, since an infant is soft and weak, the stroller may not suitable to carry the infant because the driving vibration force may transfer to the stroller. The baby may feel uncomfortable and unsafe when the stroller is shaking. During transportation, the stroller may lose its balance and turn over that may cause unwanted injury to the infant. Therefore, a bassinet is commonly used for carrying the infant. However, the conventional bassinet has the following drawbacks.

The conventional bassinet generally comprises a fabric made basin having a compartment to receive the infant therein and a supporting frame for supporting the basin. However, the conventional bassinet is usually bulky and difficult to carry because the size of the bassinet is limited by its supporting frame. Also, the bassinet is usually heavy since the supporting frame must be constructed sturdily in order to support the infant.

In order to save space for traveling and storage, most of the bassinets have a foldable structure to reduce their sizes. Traditional foldable bassinet comprises a foldable supporting frame having a plurality of joints pivotally connected with a plurality of supporting rods to form an open box structure, so that the infant can be put inside a cloth made boundary. Due to the unwanted folding up of the bassinet, infants may get hurt or unfortunately be killed accidentally.

Moreover, a structure that can be folded would not has a rigid structure due to the clearance existing in those foldable joints, so that the conventional foldable bassinet has another drawback of rocking and shaking. In other words, the conventional bassinet fails to provide an absolutely safe environment for the infants. Thus, it is unreasonable to place your infants in a risky or unsafe situation.

Besides, the infants are placed in a playpen or cot at home such that the bassinet will be stored at home. Even though the bassinet can be folded into a compact size to save storage space, the bassinet is considered as an infant carriage for outdoor, which is a waste of source.

SUMMARY OF THE PRESENT INVENTION

A main object of the present invention is to provide a bassinet with mounting arrangement for play pen or cot, wherein the bassinet is capable of incorporating with a play pen or cot without altering the original structural design of the play pen or cot. In other words, parents are able to carry their infants by the bassinet during outdoor activities and mount the bassinet on the play pen or cot at home.

Another object of the present invention is to provide a bassinet with mounting arrangement for play pen or cot, which is facilitated to be folded up into a compact size for storage and carriage.

Another object of the present invention is to provide a bassinet with mounting arrangement for play pen or cot, wherein the weight of the user, such as an infant, applied on the supporting frame of the bassinet will further ensure the folded position of the bassinet to avoid an unwanted folding up motion of the bassinet accidentally.

Another object of the present invention is to provide a bassinet with mounting arrangement for play pen or cot, wherein the detachable attachment between the bassinet and the play pen or cot does not require any tools for assembly or disassembly, such that every individual is able to operate.

Another object of the present invention is to provide a bassinet with mounting arrangement for play pen or cot, which has a simple rigid construction and is portable and lightweight.

Accordingly, in order to accomplish the above objects, the present invention provides a bassinet adapted for detachably mounting on a play pen or cot, the play pen or cot comprising a pair of spaced apart construction bars, wherein the bassinet comprises:

a box-shaped fabric boundary having a receiving cavity and a top opening communicating with the receiving cavity so as to provide four opening edges along the top opening;

a supporting board fittedly disposed in the receiving cavity;

a supporting frame comprising an edge supporting rim rigidly mounted on the opening edges of the fabric boundary, a pair of U-shaped folding arms pivotally connected to the edge supporting rim and arranged to move between a fully opened position and a closed position, and at least a locking means provided on the supporting board for locking up the two folding arms in the fully opened position, wherein in the fully opened position, the two folding arms are pivotally rotated to perpendicularly bias against the supporting board and locked up by the locking means, and in the closed position, the two folding arms are pivotally rotated towards the top opening; and a mounting arrangement comprising a pair of mounting units sidewardly extended from the edge supporting rim for detachably mounting on the two construction bars respectively so as to support the bassinet on the play pen or cot.

DETAILED DESCRIPTION OF THE PREFERRED EMBODIMENT

Figure 1:
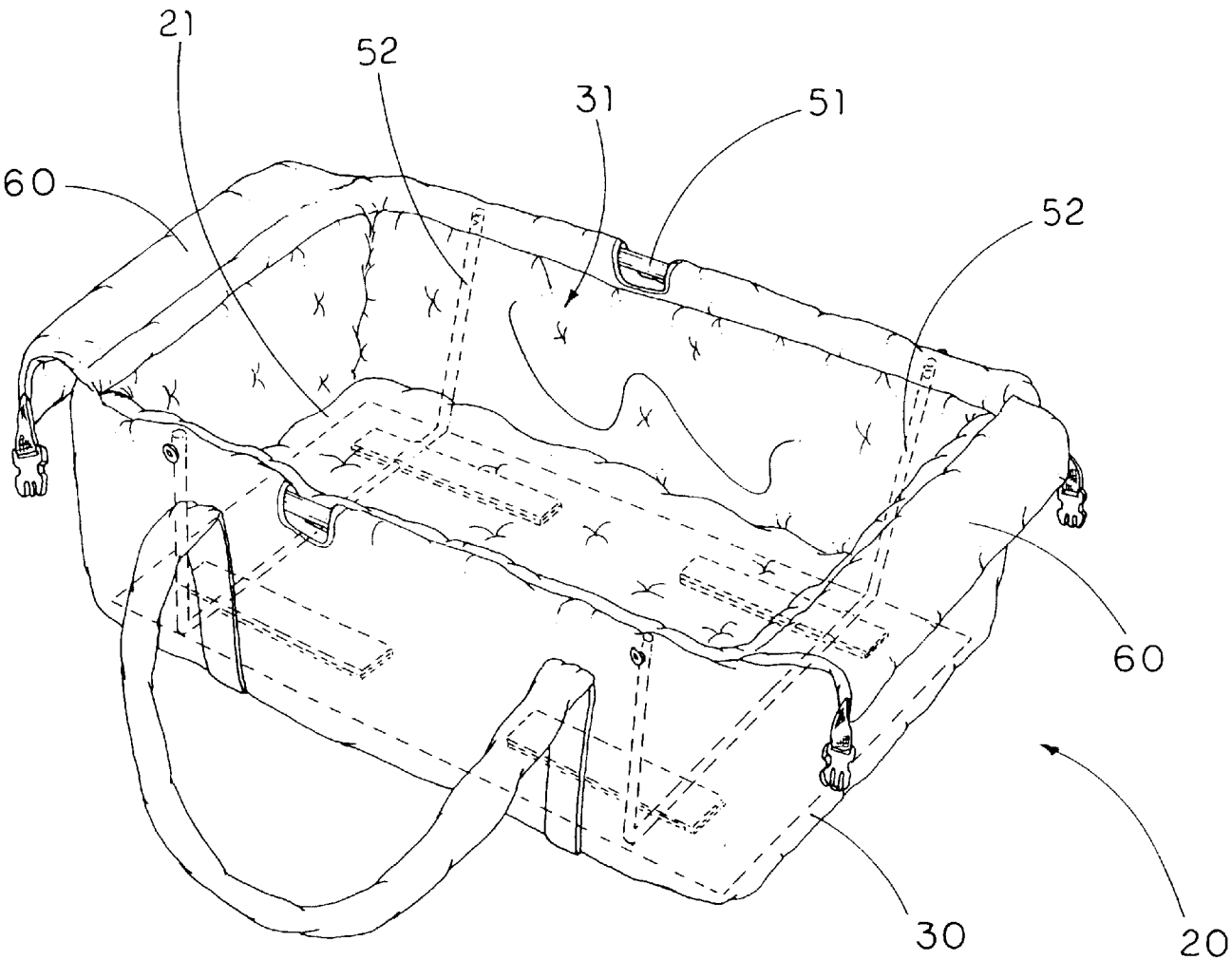
FIG. 1 is a perspective view of a bassinet with mounting arrangement for play pen or cot according to a preferred embodiment of the present invention.
Figure 2:
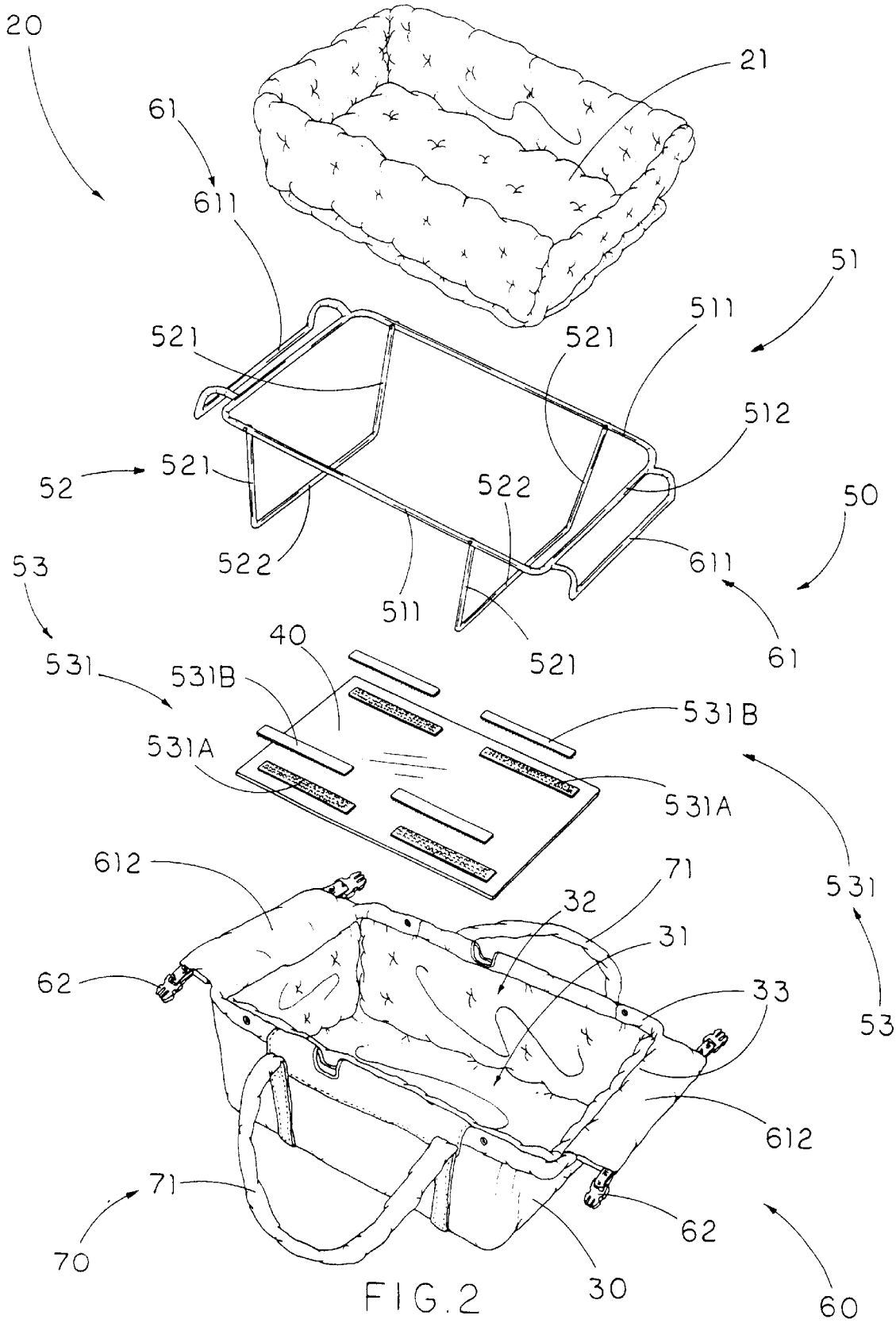
FIG. 2 is an exploded perspective view of the bassinet with mounting arrangement for play pen or cot according to the above preferred embodiment of the present invention.
Figure 4:
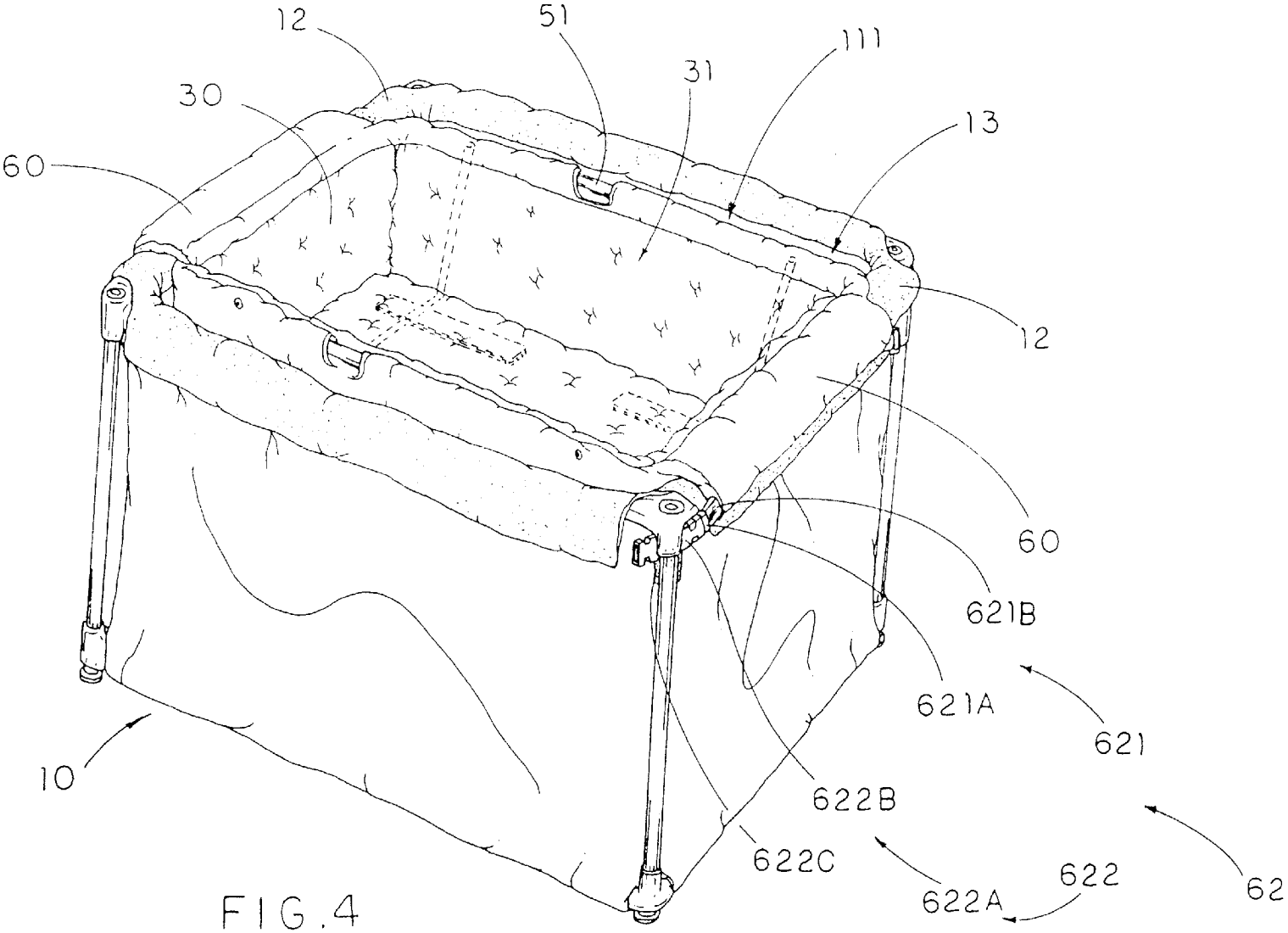
FIG. 4 is a perspective view of the bassinet mounted on the play pen or cot according to the above preferred embodiment of the present invention.

Referring to FIGS. 1, 2 and 4 of the drawings, a bassinet 20 adapted for detachably mounting on a play pen or cot 10 according to a preferred embodiment of the present invention is illustrated. The play pen or cot 10, which has a box shape such as a standard play pen or cot, comprises a frame body 11. the frame body 11 has a receiving chamber 111 and comprises two pairs of parallel construction bars 12 to form a rectangular opening 13.

The bassinet 20 comprises a box-shaped fabric boundary 30, which has a receiving cavity 31 and a top opening 32 communicating with the receiving cavity 31 so as to provide four opening edges 33 along the top opening 32, and a supporting board 40 fittedly disposed in the receiving cavity 31, wherein the fabric boundary 30 has a size and shape adapted for mounting on the play pen or cot 10 via the opening 13 thereof.

Figure 3A:
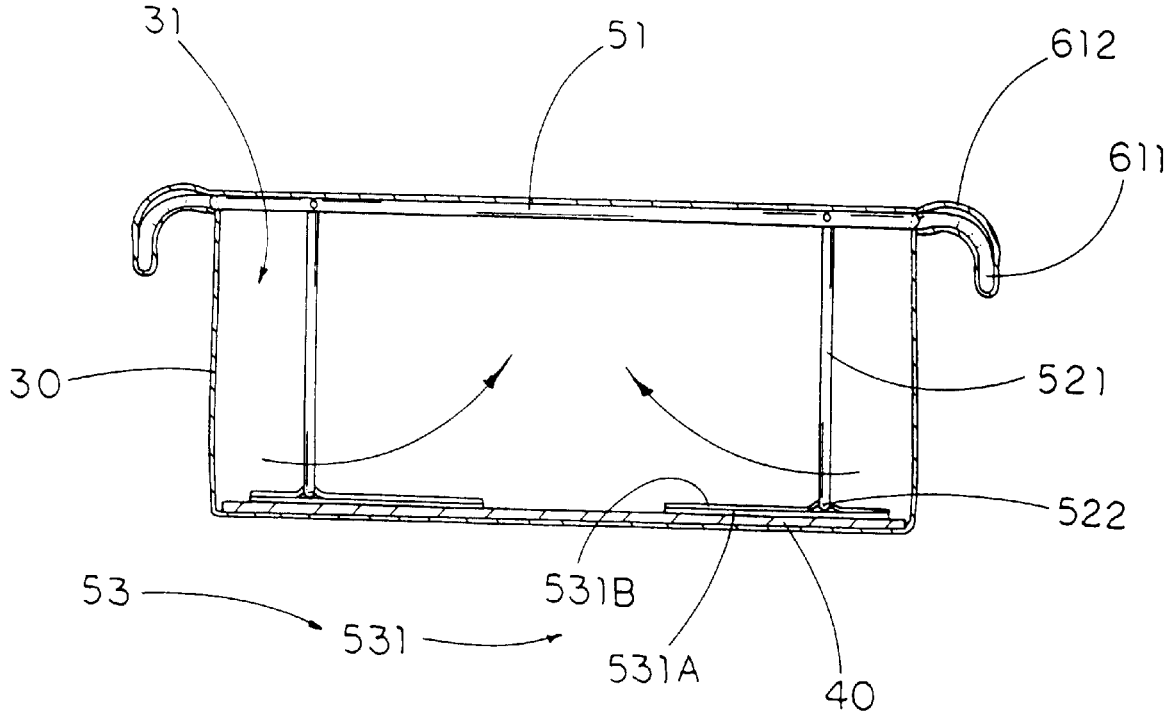
FIG. 3A is a sectional view of the bassinet in an opened position according to the above preferred embodiment of the present invention.
Figure 3B:
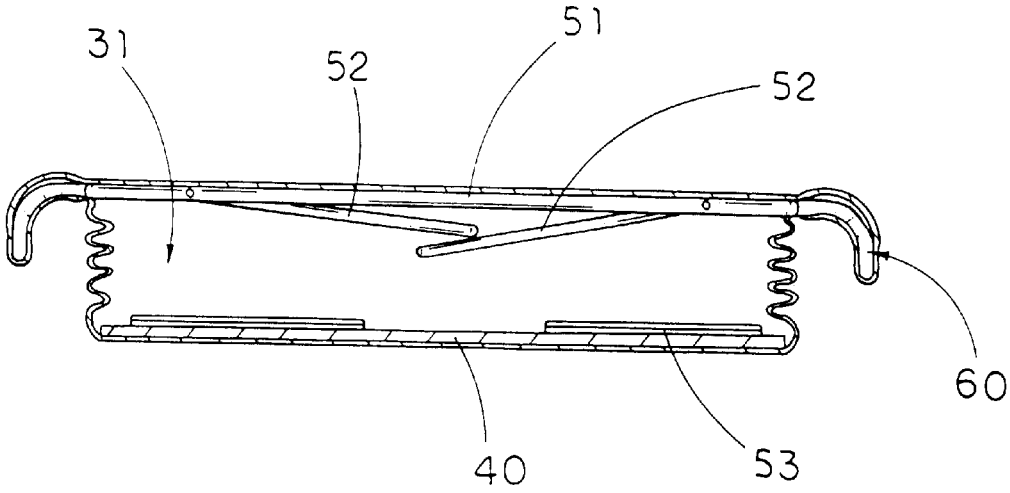
FIG. 3B is a sectional view of the bassinet in a closed position according to the above preferred embodiment of the present invention.

The bassinet 20 further comprises a supporting frame 50 and a mounting arrangement 60. The supporting frame 50 comprises an edge supporting rim 51 rigidly mounted on the opening edges 33 of the fabric boundary 30, a pair of U-shaped folding arms 52 pivotally connected to the edge supporting rim 51 and arranged to move between a fully opened position and a closed position, and at least a locking means 53 provided on the supporting board 40 for locking up the two folding arms 52 in the fully opened position. In which, in the fully opened position, as shown in FIG. 3A, the two folding arms 52 are pivotally rotated to perpendicularly bias against the supporting board 40 and locked up by the locking means 53, and in the closed position, as shown in FIG. 3B, the two folding arms 52 are pivotally rotated towards the top opening 32 so as to reduce a depth of the receiving cavity 31.

The bassinet 20 further comprises a cushion layer 21, which has a corresponding box-shaped disposed in the receiving cavity 31 and covered the supporting frame 50, wherein the cushion layer 21 is capable of providing a softer feeling when a user lays thereon.

The mounting arrangement 60 comprising a pair of mounting units 61 opposedly extended from the edge supporting rim 51 for detachably mounting on the two construction bars 12 so as to support the bassinet 20 on the play pen or cot 10, as shown in FIG. 4.

According to the preferred embodiment, the fabric boundary 30 has a predetermined size and shape to be received in the receiving chamber 111 of the play pen or cot 10 via its opening 13, wherein the opening edges 33 of the fabric boundary 30 are overlappedly attached to the edge supporting rim 51 of the supporting frame 50, so as to securely attach the fabric boundary 30 to the supporting frame 50.

The supporting board 40 having a size and shape fittedly disposed in a bottom side of the receiving cavity 31 of the fabric boundary 30 for retaining a shape of the fabric boundary 30. The supporting board 40 should be made of lightweight but rigid material such as cardboard or plastic so as to substantially support a user which is an infant thereon.

The edge supporting rim 51 comprises a pair of first longitudinal arms 511 and a pair of second longitudinal arms 512 to form a corresponding rectangular shape for the opening edges 33 of the fabric boundary 30 mounted thereto. In other words, the edge supporting rim 51 is encirclingly mounted on the top opening 32 along the opening edges 33 of the fabric boundary 30.

Each of the folding arms 52 has two pivot arm portions 521 having two ends pivotally connected to the pair of first longitudinal arms 511 of the edge supporting rim 51 respectively and a bias arm portion 522 arranged to bias against the supporting board 40 in the opened position. The pivot arm portion 521 of the folding arm 52 has a length equal to the depth of the receiving cavity 31 and the bias arm portion 522 has a length equal to a width of the fabric boundary 30, so as to fittedly retain the shape of the receiving cavity 31 in the opened position.

The locking means 53 comprises at least an elongated locking unit 531 provided on the supporting board 40 for transversely locking up the bias arm portions 522 of the two folding arms 52. The locking unit 531 comprises a first fastener 531A firmly attached on the supporting board 40 and a second fastener 531 B detachably attached to the first fastener 531A to securely hold the bias arm portion 522 between the first and second fasteners 531A, 531B. Accordingly, the first and second fasteners 531A, 531B are pair of hoop and loop fasteners adapted to provide a quick attach and detach feature.

It is apparent that the first and second fasteners 531A, 531B of the locking means 53 can be replaced by other fastening elements having a locking ability to lock up the two folding arms 52 on the supporting board 40.

Referring to FIG. 2, there are four locking units 531 provided on the supporting board 40 for locking up the bias arm portions 522 of the two folding arms 52 respectively so that the folding arms 52 are securely mount on the supporting board 40, so as to prevent the fabric boundary 30 from being unfolded accidentally.

Figure 5:
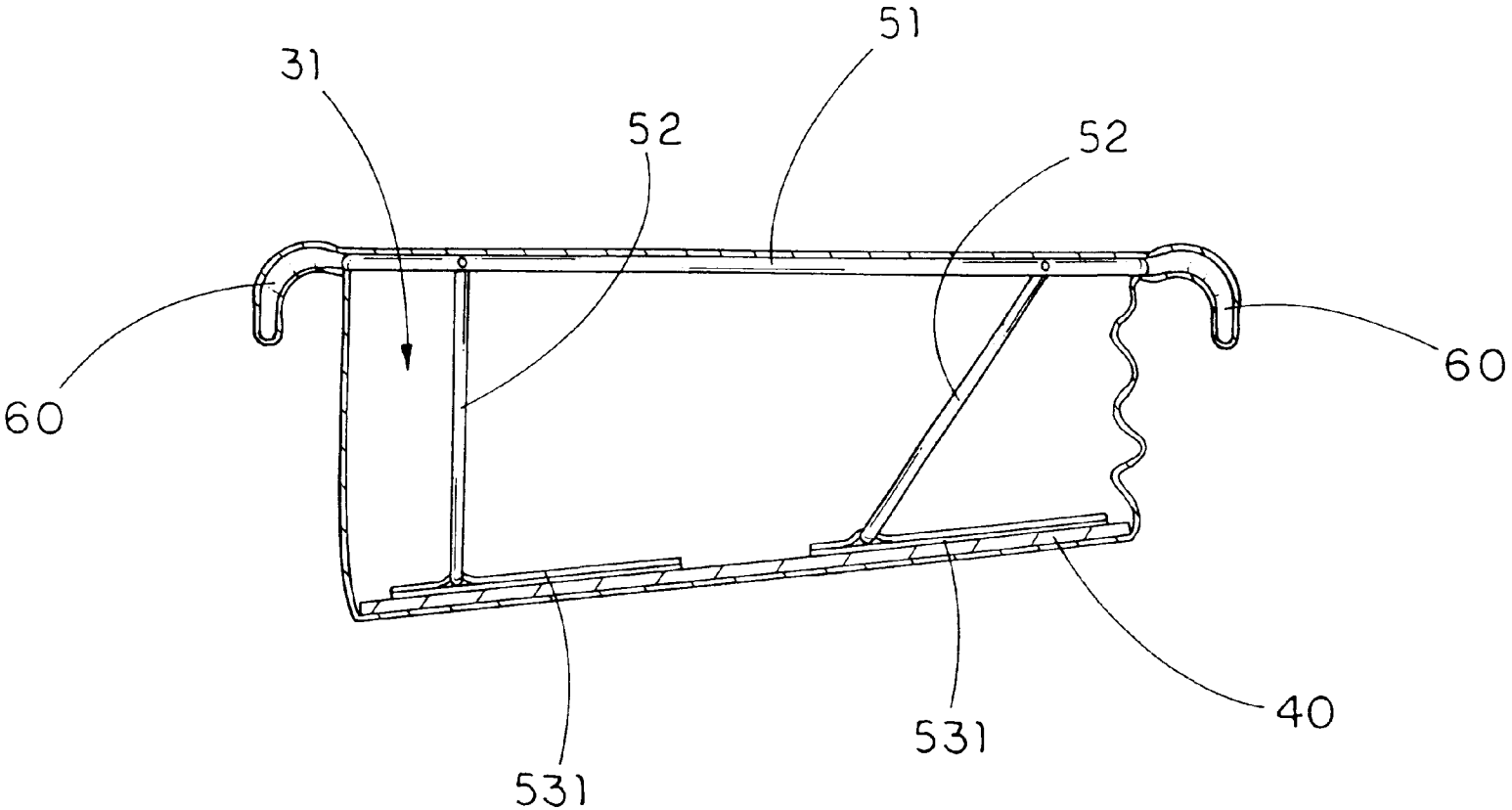
FIG. 5 is a sectional view of the bassinet according to the above preferred embodiment of the present invention, illustrating the supporting board being supported in an inclined manner.

As shown in FIG. 5, by arranging the two folding arms 52, the supporting board 40 is supported in an inclined manner. One of the folding arms 52 is perpendicularly biased against the supporting board 40 in the fully opened position while another folding arm 52 is inclinedly biased against the supporting board 40 wherein the two folding arms 52 are locked up on supporting board 40 by the locking means 53 respectively. Due to the difference bias positions of the folding arms 52, the depth of the receiving cavity 31 will be gradually reduced from on side to another side, so as to rigidly support on the supporting board 40 in an inclined manner. In other words, by varying the positions of the two folding arms 52, the supporting board 40 is capable of being selectively supported with a desired inclined angle.

Each of the mounting units 61 comprises a U-shaped mounting frame 611 sidewardly extended from the respective second longitudinal arm 512 of the edge supporting rim 51 and a fabric flap 612 extended from the respective opening edge 33 of the fabric boundary 30 for covering the mounting frame 611.

The mounting arrangement 60 further comprises at least a pair of attaching units 62 for detachably attaching the bassinet 20 to the play pen or cot 10 wherein each attaching unit 62 comprises a first attaching member 621 outwardly extended from the fabric boundary 30 and a second attaching member 622 provided on a corner of the frame body 11 of the play pen or cot 10 for detachably connecting with the first attaching member 621, so as to ensure the bassinet 20 being mounted on the play pen or cot 10, as shown in FIG. 4.

The first attaching member 621 comprises a buckle plug 621A and a fabric strap 621B extended between the fabric flap 612 and the buckle plug 621A. The second attaching member 622 comprises a main body 622A having two buckle sockets 622B opposed with each other and a fabric extension 622C extended between the main body 622A and the frame body 11 of the play pen or cot 10. Therefore, the buckle plug 621A of the first attaching member 621 can be fastened to one of the buckle sockets 622B of the second attaching member 622.

Accordingly, there are four first attaching members 621 provided on four corners of the basinet 20 and four second attaching members 622 provided on four comers of the play pen or cot such that by easily buckling up the first attaching members 621 and the second attaching members 622 respectively, the bassinet 20 can be securely mounted on the play pen or cot 10 to prevent the movement of the bassinet 20 on the play pen or cot 10.

The bassinet 20 further comprises a handle means 70 for carrying the fabric boundary 30 wherein the handle means 70 comprises a pair of carrying belts 71 provided on two outer sides of the fabric boundary 30 such that the users, such as the parents, are able to carry the bassinet 20 via the carrying belts 71. Accordingly, each of the carrying belts 71 has two ends firmly attached to the fabric boundary 30 by stitching to form a loop structure.

It is worth to mention that in order to fold up the supporting frame, the upward pivotal force must be applied on the two folding arms 52. Therefore, when the infant is placed on the supporting board 40, a downward force which is the weight of the infant will applied on the folding arms 52 so as to prevent the supporting frame being folded up accidentally and further enhance the safety of the bassinet.

Figure 6:
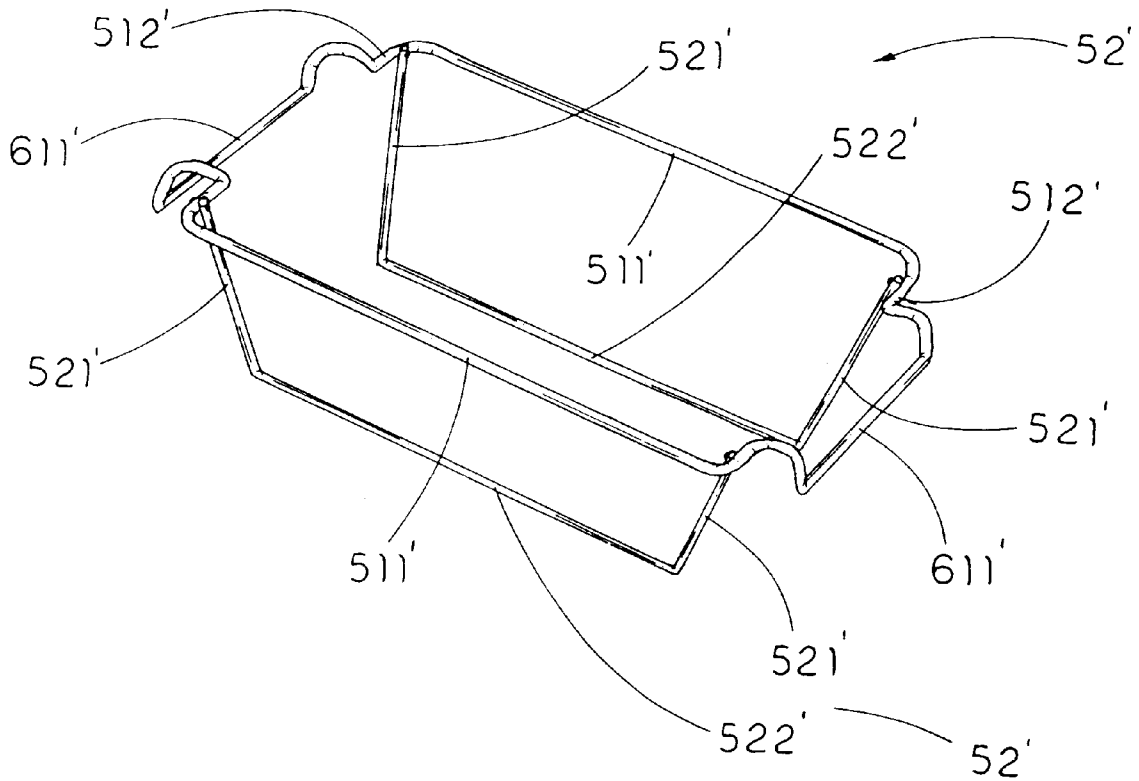
FIG. 6 illustrates an alternative mode of a supporting frame of the bassinet with mounting arrangement for play pen or cot according to the above preferred embodiment of the present invention.

FIG. 6 illustrates an alternative mode of the supporting frame 50' which comprises the edge supporting rim 51' comprising the pair of first longitudinal arms 511' and a pair of second longitudinal arms 512' to form a corresponding rectangular shape. The two U-shaped folding arms 52' is pivotally connected to the second longitudinal arms 512' of the edge supporting rim 51', wherein the two mounting frames 611' are integrally extended from the second longitudinal arms 512' of the edge supporting rim 51' respectively.

In view of the above preferred embodiments, it should be appreciated that certain obvious modifications, variations, and substitutions may be made without departing from the spirit and scope of the present invention.

What is claimed is:

1. A bassinet for detachably mounting on a play pen or cot which comprises a pair of spaced apart construction bars, wherein said bassinet comprises:

a fabric boundary having a receiving cavity and a top opening communicating with said receiving cavity so as to provide at least an opening edge along said top opening;

a supporting board fittedly disposed in said receiving cavity;

a supporting frame comprising an edge supporting rim rigidly mounted on said opening edge of said fabric boundary, a pair of U-shaped folding arms pivotally connected to said edge supporting rim and arranged to move between a fully opened position and a closed position, and at least a locking means provided on said supporting board for locking up said two folding arms in said fully opened position, wherein in said fully opened position, said two folding arms are pivotally rotated to perpendicularly bias against said supporting board and locked up by said locking means, and in said closed position, said two folding arms are pivotally rotated towards said top opening; and a mounting arrangement comprising a pair of mounting units sidewardly extended from said edge supporting rim for detachably mounting on said two construction bars respectively so as to support said bassinet on said play pen or cot.

2. The bassinet, as recited in claim 1, wherein said edge supporting rim comprises a pair of first longitudinal arms and a pair of second longitudinal arms to form a corresponding rectangular shape for the opening edges of said fabric boundary mounted thereto.

3. The bassinet, as recited in claim 2, wherein each of said folding arms has two pivot arm portions having two ends pivotally connected to said pair of first longitudinal arms of said edge supporting rim respectively and a bias arm portion arranged to bias against said supporting board in said fully opened position, wherein each said pivot arm portion of said folding arm has a length equal to a depth of said receiving cavity and each said bias arm portion has a length equal to a width of said fabric boundary.

4. The bassinet, as recited in claim 3, wherein said locking means comprises at least one elongated locking unit provided on said supporting board for locking up said bias arm portions of said two folding arms, wherein said at least one locking unit comprises a first fastener firmly attached on said supporting board and a second fastener detachably attached to said first fastener to securely hold said bias arm portion between said first and second fasteners.

5. The bassinet, as recited in claim 4, wherein said first and second fasteners are hook and loop fasteners.

6. The bassinet, as recited in claim 2, wherein each of said mounting units comprises a U-shaped mounting frame sidewardly extended from said respective second longitudinal arm of said edge supporting rim and a fabric flap extended from said respective opening edge of said fabric boundary for covering said mounting frame.

7. The bassinet, as recited in claim 4, wherein each of said mounting units comprises a U-shaped mounting frame sidewardly extended from said respective second longitudinal arm of said edge supporting rim and a fabric flap extended from said respective opening edge of said fabric boundary for covering said mounting frame.

8. The bassinet, as recited in claim 6, wherein said mounting arrangement further comprises at least a pair of attaching units for detachably attaching said bassinet to said play pen or cot, wherein each of said attaching units comprises a first attaching member outwardly extended from said fabric boundary and a second attaching member provided on said play pen or cot for detachably connecting with said first attaching member.

9. The bassinet, as recited in claim 7, wherein said mounting arrangement further comprises at least a pair of attaching units for detachably attaching said bassinet to said play pen or cot, wherein each attaching unit comprises a first attaching member outwardly extended from said fabric boundary and a second attaching member provided on said play pen or cot for detachably connecting with said first attaching member.

10. The bassinet, as recited in claim 1, wherein each of said folding arms has two pivot arm portions having two ends pivotally connected to a pair of longitudinal arms of said edge supporting rim respectively and a bias arm portion arranged to bias against said supporting board in said fully opened position, wherein each said pivot arm portion of said folding arm has a length equal to a depth of said receiving cavity and each said bias arm portion has a length equal to a width of said fabric boundary.

11. The bassinet, as recited in claim 10, wherein said locking means comprises at least one elongated locking unit provided on said supporting board for locking up said bias arm portions of said two folding arms, wherein said at least one locking unit comprises a first fastener firmly attached on said supporting board and a second fastener detachably attached to said first fastener to securely hold said bias arm portion between said first and second fasteners.

12. The bassinet, as recited in claim 10, wherein each of said mounting units comprises a U-shaped mounting frame sidewardly extended from said respective second longitudinal arm of said edge supporting rim and a fabric flap extended from said respective opening edge of said fabric boundary for covering said mounting frame.

13. The bassinet, as recited in claim 11, wherein each of said mounting units comprises a U-shaped mounting frame sidewardly extended from said respective second longitudinal arm of said edge supporting rim and a fabric flap extended from said respective opening edge of said fabric boundary for covering said mounting frame.

14. The bassinet, as recited in claim 13, wherein said mounting frame is integral with said respective second longitudinal arm of said edge supporting rim.

15. The bassinet, as recited in claim 12, wherein said mounting arrangement further comprises at least a pair of attaching units for detachably attaching said bassinet to said play pen or cot, wherein each of said attaching units comprises a first attaching member outwardly extended from said fabric boundary and a second attaching member provided on said play pen or cot for detachably connecting with said first attaching member.

16. The bassinet, as recited in claim 13, wherein said mounting arrangement further comprises at least a pair of attaching units for detachably attaching said bassinet to said play pen or cot, wherein each of said attaching units comprises a first attaching member outwardly extended from said fabric boundary and a second attaching member provided on said play pen or cot for detachably connecting with said first attaching member.

17. The bassinet, as recited in claim 15, wherein said first attaching member comprises a buckle plug and a fabric strap extended between said fabric flap and said buckle plug and said second attaching member comprises a main body having two buckle sockets positioned opposed with each other and a fabric extension extended between said main body and a corner of said play pen or cot, wherein said buckle plug of said first attaching member is adapted to fasten to one of said buckle sockets of said second attaching member for securely mounting said bassinet on said play pen or cot.

18. The bassinet, as recited in claim 16, wherein said first attaching member comprises a buckle plug and a fabric strap extended between said fabric flap and said buckle plug and said second attaching member comprises a main body having two buckle sockets positioned opposed with each other and a fabric extension extended between said main body and a corner of said play pen or cot, wherein said buckle plug of said first attaching member is adapted to fasten to one of said buckle sockets of said second attaching member for securely mounting said bassinet on said play pen or cot.

19. A bassinet for detachably mounting on a play pen or cot which comprises a frame body, said frame body comprising a pair of spaced apart construction bars; said bassinet comprising:

a fabric boundary having a receiving cavity and a top opening communicating with said receiving cavity so as to provide at least an opening edge along said top opening;

a supporting frame comprising an edge supporting rim rigidly mounted on said opening edge of said fabric boundary;

a mounting arrangement comprising a pair of mounting units sidewardly extended from said edge supporting rim for detachably mounting on said two construction bars respectively so as to support said bassinet on said play pen or cot, and at least a pair of attaching units for detachably attaching said bassinet to said play pen or cot, wherein each of said attaching units comprises a first attaching member outwardly extended from said fabric boundary and a second attaching member provided on said play pen or cot for detachably connecting with said first attaching member; and a supporting board fittedly disposed in said receiving cavity, wherein said supporting frame further comprises a pair of U-shaped folding arms pivotally connected to said edge supporting rim and arranged to move between a fully opened position and a closed position, and at least a locking means provided on said supporting board for locking up said two folding arms in said fully opened position, wherein in said fully opened position, said two folding arms are pivotally rotated to perpendicularly bias against said supporting board and locked up by said locking means, and in said closed position, said two folding arms are pivotally rotated towards said top opening.

20. A bassinet for detachably mounting on a play pen or cot which comprises a frame body, said frame body comprising a pair of spaced apart construction bars; said bassinet comprising:

a fabric boundary having a receiving cavity and a top opening communicating with said receiving cavity so as to provide at least an opening edge along said top opening;

a supporting frame comprising an edge supporting rim rigidly mounted on said opening edge of said fabric boundary;

a mounting arrangement comprising a pair of mounting units sidewardly extended from said edge supporting rim for detachably mounting on said two construction bars respectively so as to support said bassinet on said play pen or cot, and at least a pair of attaching units for detachably attaching said bassinet to said play pen or cot, wherein each of said attaching units comprises a first attaching member outwardly extended from said fabric boundary and a second attaching member provided on said play pen or cot for detachably connecting with said first attaching member, wherein said first attaching member comprises a buckle plug and a fabric strap extended between said fabric boundary and said buckle plug and said second attaching member comprises a main body having two buckle sockets positioned opposed with each other and a fabric extension extended between said main body and a corner of said frame body, wherein said buckle plug of said first attaching member is adapted to fasten to one of said buckle sockets of said second attaching member for securely mounting said bassinet on said play pen or cot; and a supporting board fittedly disposed in said receiving cavity, wherein said supporting frame further comprises a pair of U-shaped folding arms pivotally connected to said edge supporting rim and arranged to move between a fully opened position and a closed position, and at least a locking means provided on said supporting board for locking up said two folding arms in said fully opened position, wherein in said fully opened position, said two folding arms are pivotally rotated to perpendicularly bias against said supporting board and locked up by said locking means, and in said closed position, said two folding arms are pivotally rotated towards said top opening.

21. The bassinet, as recited in claim 20, wherein said edge supporting rim comprises a pair of first longitudinal arms and a pair of second longitudinal arms to form a corresponding rectangular shape for the opening edges of said fabric boundary mounted thereto, wherein each of said folding arms has two pivot arm portions having two ends pivotally connected to said pair of first longitudinal arms of said edge supporting rim respectively and a bias arm portion arranged to bias against said supporting board in said fully opened position, wherein each said pivot arm portion of said folding arm has a length equal to a depth of said receiving cavity and each said bias arm portion has a length equal to a width of said fabric boundary.

22. The bassinet, as recited in claim 21, wherein said locking means comprises at least one elongated locking unit provided on said supporting board for locking up said bias arm portions of said two folding arms, wherein said at least one locking unit comprises a first fastener firmly attached on said supporting board and a second fastener detachably attached to said first fastener to securely hold said bias arm portion between said first and second fasteners.

23. The bassinet, as recited in claim 22, wherein each of said mounting units comprises a U-shaped mounting frame sidewardly extended from said respective second longitudinal arm of said edge supporting rim and a fabric flap extended from said respective opening edge of said fabric boundary for covering said mounting frame.

24. A bassinet for detachably mounting on a play pen or cot which comprises a frame body, said frame body comprising a pair of spaced apart construction bars; said bassinet comprising:

a fabric boundary having a receiving cavity and a top opening communicating with said receiving cavity so as to provide at least an opening edge along said top opening;

a supporting frame comprising an edge supporting rim rigidly mounted on said opening edge of said fabric boundary;

a mounting arrangement comprising a pair of mounting units sidewardly extended from said edge supporting rim for detachably mounting on said two construction bars respectively so as to support said bassinet on said play pen or cot, and at least a pair of attaching units for detachably attaching said bassinet to said play pen or cot, wherein each of said attaching units comprises a first attaching member outwardly extended from said fabric boundary and a second attaching member provided on said play pen or cot for detachably connecting with said first attaching member, wherein said first attaching member comprises a buckle plug and a fabric strap extended between said fabric boundary and said buckle plug and said second attaching member comprises a main body having two buckle sockets positioned opposed with each other and a fabric extension extended between said main body and a corner of said frame body, wherein said buckle plug of said first attaching member is adapted to fasten to one of said buckle sockets of said second attaching member for securely mounting said bassinet on said play pen and cot, wherein said edge supporting rim comprises a pair of first longitudinal arms and a pair of second longitudinal arms to form a corresponding rectangular shape for the opening edges of said fabric boundary mounted thereto, wherein each of said folding arms has two pivot arm portions having two ends pivotally connected to said pair of first longitudinal arms of said edge supporting rim respectively and a bias arm portion arranged to bias against said supporting board in said fully opened position, wherein each said pivot arm portion of said folding arm has a length equal to a depth of said receiving cavity and each said bias arm portion has a length equal to a width of said fabric boundary.

25. The bassinet, as recited in claim 24, wherein said locking means comprises at least one elongated locking unit provided on said supporting board for locking up said bias arm portions of said two folding arms, wherein said at least one locking unit comprises a first fastener firmly attached on said supporting board and a second fastener detachably attached to said first fastener to securely hold said bias arm portion between said first and second fasteners.

26. The bassinet, as recited in claim 24, wherein each of said mounting units comprises a U-shaped mounting frame sidewardly extended from said respective second longitudinal arm of said edge supporting rim and a fabric flap extended from said respective opening edge of said fabric boundary for covering said mounting frame.

* * * * *